United States Patent [19]

Donaghue et al.

[11] 4,369,689

[45] Jan. 25, 1983

[54] METHOD FOR MIXING AND PLACING EXPLOSIVE COMPOSITIONS

[75] Inventors: Paul F. Donaghue, Bundoora; Thomas L. Love, Deer Park; Kenneth A. W. Mitchell, Cheltenham; Maxwell G. Pitt, Prahran, all of Australia

[73] Assignee: ICI Australia Limited, Victoria, Australia

[21] Appl. No.: 190,251

[22] Filed: Sep. 24, 1980

[30] Foreign Application Priority Data

Oct. 5, 1979 [AU] Australia ..... PE0804

[51] Int. Cl.[3] ..... C06D 1/08

[52] U.S. Cl. ..... 86/20 C; 86/1 R; 86/20 D; 118/303; 149/7

[58] Field of Search ..... 34/28, 36, 56; 86/1 R, 86/20 C, 20 D; 118/303; 149/7, 19.4; 427/421

[56] References Cited

U.S. PATENT DOCUMENTS

| | | | |
|---|---|---|---|
| 2,071,846 | 2/1937 | Lamb et al. | 118/303 |
| 3,013,525 | 12/1961 | Fuller et al. | 118/303 X |
| 3,022,149 | 2/1962 | Cramer | 149/19.1 |
| 3,303,738 | 2/1967 | Clay et al. | 86/20 C |
| 4,275,682 | 6/1981 | Weber | 118/303 |

*Primary Examiner*—Leland A. Sebastian

*Attorney, Agent, or Firm*—Cushman, Darby & Cushman

[57] ABSTRACT

A process, and apparatus for performing same, of simultaneous mixing and placement of an explosive composition comprising a dispersion of an explosive component located in and immobilized by a solidified foamed non-explosive matrix.

8 Claims, 3 Drawing Figures

METHOD FOR MIXING AND PLACING EXPLOSIVE COMPOSITIONS

This invention relates to processes of manufacture and placement of explosive compositions comprising a dispersion of particles of explosive material located in and immobilized by a non-explosive foamed matrix.

Explosive compositions have been known for several centuries and have been used in a variety of forms such as in the form of free flowing gunpowder; as a gelatinized material such as dynamite wherein an explosive is dispersed in an extruded gel form; as a free flowing mixture of particulate oxygen releasing salts and a liquid organic fuel; or as a water based slurry comprising oxygen releasing salts, fuel material and water. Such compositions have been useful as sources of energy which could be utilized for firing ammunition or for use as blasting agents. Hitherto generally such explosives have been manufactured in a manner having as its objective an explosive composition in which the ratio of latent energy per unit volume of the composition is as great as possible. Thus for example in the specification of U.S. Pat. No. 2,768,072 there is described a process for making an explosive composition wherein a high explosive such as trinitrotoluene, nitrocellulose, pentaerythritol or cyclotrimethylenetrinitramine is dissolved in an organic solvent, and the solution is added to a gelled polymeric resin which is then foamed by injection of air to provide a cellular explosive which has a greater and more shattering effect than the same weight of high density explosive. It has been proposed in Australian Patent Specification No. 231 043 to provide a self supporting deformable explosive composition having a high density and a high detonation velocity and which comprises a high explosive compound admixed with a binding agent consisting of an elastomer such as butyl rubber and a thermoplastic terpene hydrocarbon resin such as a polymer of beta-pinene. It has also been proposed in U.S. Pat. No. 3,256,214 to prepare explosive resins comprised of crosslinked thermosetting polymers typified by modified polyurethanes having as an essential component nitric acid ester groups. Such explosive resins are claimed in U.S. Pat. No. 3,309,247 to be useful for coating ammonium nitrate compositions. This objective of developing compositions having such a great ratio was laudable, especially when the explosive industry was in its infancy and it was difficult to produce high powered explosives, since it reduced the costs of packaging, transporting or storing the explosive compositions and minimized the volume of explosive necessary to achieve a desired result when the latent energy thereof was released by detonation. With the development of technology relating to the manufacture of explosives the ratio of latent energy per unit volume of explosive is often very great with modern explosives and it has now become desirable to be able to control the effect of the release of the energy in a manner which is more efficient than has hitherto been possible. Thus it has been proposed to mix explosive materials with a low density inert material and a typical example of such a mixture is described in the specification of British Pat. No. 1,177,732 wherein a high explosive material is admixed with spherical particles of a filler having a density of less than 0.1. This type of explosive is exemplified by a composition wherein filler particles of foamed polystyrene or foamed polyurethane are coated with the explosive material to provide an explosive having a fluid-bed consistency. It has also been proposed in British Patent Specification No. 1,239,771 to provide an explosive charge comprising a sintered homogeneous mixture of a granular meltable explosive such as a trinitrotoluene and a gas-containing, porous or voluminous substance such as microspheres and foam plastics or powdered cork. Yet again in Australian Patent Specification No. 204,739 it has been proposed to grind an oxidizing salt to a very fine powder, add it to a liquid phenol-, urea- or melamine-formaldehyde condensation product and thereafter polymerize the condensate to provide a stable sold pyrotechnic mass suitable for fireworks. It has been proposed also in Australian Patent Specification No. 287,723 to provide a process for the manufacture of explosives having a rigid structure from insensitive explosive substances in which the explosive substances are mixed with at least one plasticizer to give them a gelatinous structure followed by a heat treatment whereby the gelatinous structure is changed into a rigid structure.

In U.S. Pat. No. 4,151,022 there is disclosed an explosive composition comprising a dispersion of an explosive component which is located in and immobilized by a solidified non-explosive matrix. A convenient form of such a composition is one which has an explosive component comprising at least one inorganic oxygen releasing salt and a non-explosive matrix of a foamed plastics material made by a chemical stabilization process as defined on page 853 to 855 in Volume 9 of the Kirk-Othmer Encyclopedia of Chemical Technology 2nd edition, Interscience publishers 1966. An example of such an explosive composition is one in which the explosive component comprises ammonium nitrate and the non-explosive matrix is a polyurethane foam.

For the purpose of clarity in describing the present invention reference will be made to processes for the manufacture and placement of ammonium nitrate/polyurethane foam (AN/PF) explosive compositions although the process of the invention is equally applicable to other explosive compositions as described in U.S. Pat. No. 4,151,022.

The essential raw materials for the manufacture of AN/PF explosive compositions are ammonium nitrate, a poly-functional isocyanate and a hydroxyl containing polymer. The polyurethane foam is formed by the reaction of the latter two materials, a portion of which also acts as fuel for the ammonium nitrate. These raw materials are more easily transported than the AN/PF explosive compositions because they are more dense and relatively non-explosive. Therefore it is desirable to make the AN/PF explosive compositions as close to the point of use as possible. When the explosives are to be used in mining or quarrying operations it is ideal to manufacture and place them simultaneously in the bore holes.

There are problems associated with doing this, mainly as regards placing the mixed polyurethane ingredients, or liquid polyurethane precursor, into the borehole without undesirble build-up occurring on the walls of the borehole and also as regards efficient mixing of the explosive particles with the mixed polyurethane ingredients in order to obtain eventually an even distribution of the explosive particles throughout the foam matrix.

Mixing processes using augers for the polyurethane foam ingredients with other particulate materials are well known but they are not suited to intermittent operation as is required when filling a series of boreholes.

Frequent stopping of the mixing equipment causes build-up of the mixed ingredients in the equipment which react to form foam within the mixer which then has to be cleaned out. Moreover if the unreacted mix is poured or pumped down the bore hole, it is liable to stick to the sides of the hole and react, thereby foaming and expanding, thus preventing further reactants from flowing down the hole.

Even distribution of the ammonium nitrate within the AN/PF composition is essential otherwise the propagation of the explosion is erratic and misfires may be caused.

We have now found that if, in filling a bore hole, or similar container, with the raw materials of a foamed explosive composition, as hereinbefore described, the process of addition is such that the liquid precursor materials for the foam matrix are enveloped in a curtain of solid particles of the inorganic oxygen releasing salt, such as ammonium nitrate, the problems of build-up of foam in undesirable places and uneven distribution of the particles of the inorganic oxygen releasing salt are largely overcome.

Accordingly the present invention provides a process for the simultaneous mixing and introduction into a container of ingredients to form an explosive composition therein, said composition comprising a dispersion of an inorganic oxygen releasing salt located in, and immobilised by, a solidified foamed non-explosive matrix derived from a liquid precursor, in which process a stream of liquid droplets of the said precursor is introduced into the container concurrently with a stream of solid particles comprising the said inorganic oxygen releasing salt, the process being characterised in that at all times during the introduction of the said stream of liquid droplets the said stream of solid particles envelop the said stream of liquid droplets.

Commonly the container into which the ingredients of the explosive compositions are to be introduced are bore holes such as are used in mining and quarrying operations and which are of downwards vertical, or near vertical, orientation. However the process of the invention may be used to manufacture and place said explosive compositions in any form of container which has suitable provision for the addition of materials through its top, eg it should be a hollow container with an opening at its top and the cross-sectional dimensions of the opening should approximate to the maximum horizontal cross-sectional dimensions of the container.

The inorganic oxygen releasing salt may be one selected from the group of nitrates, chlorate and perchlorate of alkali metals, alkaline earth metals and ammonium, or a mixture of two or more of said salts. Preferably it is ammonium nitrate, optionally mixed with sodium nitrate. The maximum particle size of the salt particles is limited by the physical dimensions of the equipment by which the process of the invention may be carried out, the minimum particle size is that below which the particles will not fall freely under the influence of gravity. Preferably the particles are substantially spherical and in the size range of 1000 microns to 3000 microns.

The liquid precursor to the solidified foamed non-explosive matrix is a mixture of reactants which on subsequent reaction will produce the desired foam. Preferably the foam is a polyurethane foam made from a liquid precursor comprising a mixture of at least one polyfunctional isocyanate, a hydroxyl-container polymer, or polyol, and catalysts necessary to control the rate and type of reaction. The reaction between the ingredients in the precursor will not have proceeded beyond the stage at which the precursor ceases to be liquid. The precursor must be capable of being formed into liquid droplets.

The liquid precursor droplets are formed by known methods such as pouring or pumping the liquid through multiplicity of small orifices, or by spraying through a suitable nozzle by pressure or with compressed air.

The streams of droplets and particles may be propelled into the container but preferably they are allowed to fall under the influence of gravity after generation. It is a necessary characteristic of the process of this invention that the stream of solid particles is generated above the point where the stream of liquid droplets is generated.

Figure 1:
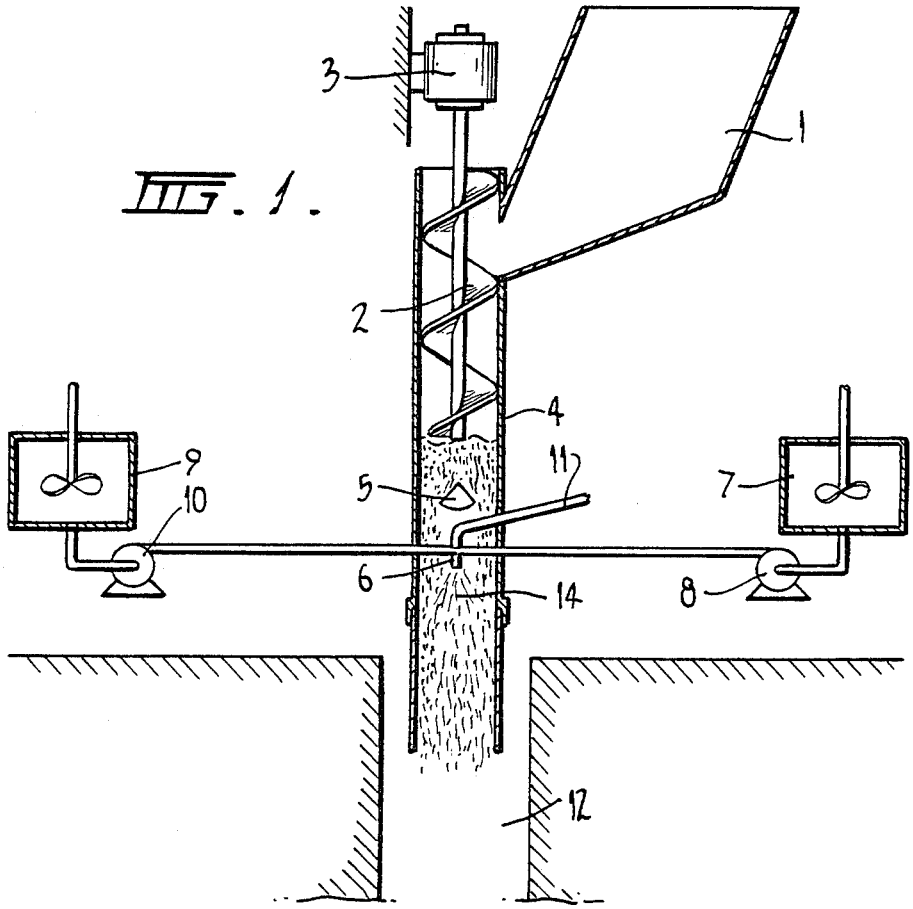
FIG. 1 is a perspective view of the apparatus with a simulated borehole.

In order to illustrate the process of the invention reference is made to FIG. 1 which is a diagrammatic representation, not to scale, of one form of equipment which may be used to manufacture and place the explosive compositions into boreholes and the like. The explosive composition to be made by the embodiment of the process of the invention to be described comprises ammonium nitrate and a polyurethane foam. The ammonium nitrate particles which are stored in hopper 1 are caused to flow from the hopper at a controlled rate by the auger 2 driven by motor 3. As they fall from the bottom of the auger through the cylindrical casing 4, some impinge on a cone shaped deflector plate 5 which causes the falling stream of solid particles to assume a hollow cylindrical configuration.

This cylindrical stream of particles falls around a nozzle 6 through which a mixture of an isocyanate, which has been pumped from holding tank 7 by pump 8, and a polyol, which has been pumped from holding tank 9 by pump 10, is sprayed by compressed air fed through pipe 11.

The stream of liquid droplets generated through the nozzle is thus enveloped by the falling cylindrical stream of solid particles. The flow rates of the two streams is adjusted by controlling the speed of the motor 3 and the pumps 8 and 10 to give the desired proportions of the ingredients of the explosive composition. The internal diameter of the cylindrical casing is chosen to be no greater than the borehole 12 in which the explosive composition is being placed. The pressure of the compressed air used to spray the liquid polyurethane precursor is controlled so that the liquid droplets are substantially all contained by the enveloping stream of solid particles.

As the streams of liquid droplets and solid particles fall together down the borehole, the droplets and particles impinge on one another thereby causing the particles to become coated with liquid precursor so that the mass which collects at the bottom of the hole is an even dispersion of ammonium nitrate particles in a matrix of polyurethane precursor. As the reaction proceeds this precursor matrix swells and foams to form the solidified foam matrix in which particles of the explosive component are evenly dispersed.

The explosive component comprises ammonium nitrate particles which have absorbed a small proportion of the liquid polyurethane precursor which will act as a fuel.

The foregoing description is not to be construed as limiting on the invention but is merely given by way of illustration. There are many variations on the equipment used, for example the auger 2 may be replaced by a star-feeder or vibratory feeder, also the spray nozzle 6 may be so devised as to provide the means of deflecting the solid particles to form the enveloping hollow stream thus dispensing with the deflector 5.

Figure 2:
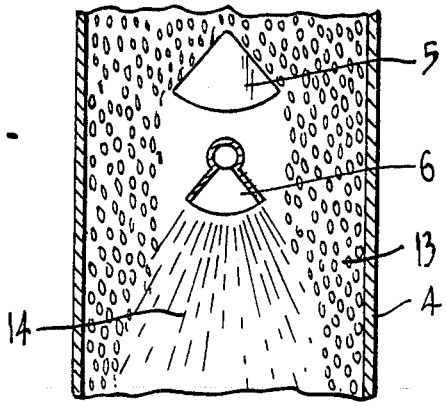
FIG. 2 illustrates a vertical cross-section showing the falling stream of solid particles.

By 'envelop' we mean that the stream of liquid droplets are surrounded by the stream of solid particles such that substantially all the liquid droplets are contained within the outer dimension of the stream of solid particles as illustrated in FIG. 2. FIG. 2 illustrates a vertical cross-section of the falling stream of solid particles 13 and spray of liquid droplets 14.

Accordingly the present invention also provides an apparatus for carrying out the process according to the invention, which apparatus comprises a length of hollow tubing, preferably cylindrical, mounted with its axis in a vertical, or near vertical, direction which tubing encases a means of introducing a steady falling stream of solid particles, a means of deflecting said stream to form a hollow falling stream, and a means of generating a falling stream of liquid droplets within said hollow falling stream of solid particles.

The falling stream of solid particles has a cleansing action on the inside of the casing of the equipment and on the inside walls of the borehole or container thereby preventing undesirable build-up.

Surprisingly we have found that the degree of mixing which is achieved between the solid particles and liquid droplets is very high which means that even dispersion of the explosive component is achieved. Moreover the coating of liquid precursor which is formed on the solid particles has a beneficial effect if, as sometimes happens, the explosive is being loaded into bore holes containing water. The liquid precursor coating impedes dissolution of the solid particles, which because they are denser than water will sink, eventually displacing the water from the hole.

The process of the invention allows for wide variation of the density of explosive composition by suitable choice of the matrix and proportion of the raw materials. The density of the explosive composition of the product—which conveniently may lie in the range from 0.1 to 0.7 gram cubic centimeter—is of particular importance in so far as it provides a means whereby the amount of explosive material located within a given space may be controlled especially in the instance where the explosive material is to be used in relatively small amounts to dislodge, disperse or remove an amount of material. The process is particularly useful for the control of the bulk energy of explosives for use in areas where soft rock or overburden is to be blasted, and especially in areas where the strength of the rock to be broken varies across a face.

The invention is now illustrated by, but not limited to, the following examples in which all parts or percentages are on a weight basis unless otherwise specified.

EXAMPLE 1

An apparatus such as illustrated by FIG. 1 was used to make and place an AN/PF composition in a simulated borehole.

The simulated borehole was a 10 meter length of tubing of 125 mm ID made of plastics material mounted vertically in a supporting gantry.

An AN/PF loading apparatus was mounted above the simulated borehole. It comprised a hopper from which the contents could be extracted at a controlled rate by controlling the speed of an auger which was mounted within a hollow cylindrical casing of 75 mm diameter. A deflecting cone of 25 mm basal diameter was mounted centrally in the casing below the auger and above a spray nozzle. Liquid polyurethane precursor was formed from two ingredients "Suprasec" DND ("Supresec" is a registered trade mark, and "Suprasec" DND is the trade name for a blend of diisocyanto diphenylmethane based isocyanates) and "Daltolac" 41 ("Daltolac" which is a registered trade mark is the trade name for an alkylene oxide condensate of an amine) which were separately pumped in metered quantities, such that the weight ratio of "Suprasec" to "Daltolac" was 1.8:1, from separate containers to the spray nozzle to which there was also a supply of compressed air.

Ammonium nitrate prills, 80% on a w/w basis of which were in the size range of 1700 microns to 2400 microns and >95% were in the size range of 1000 microns to 3000 microns were withdrawn from the hopper by the auger at a rate of 23 kg/min. The prills fell as a stream and were deflected by the cone to form a hollow cylindrical stream within the casing falling around the spray nozzle. The polyurethane precursor ingredients were sprayed through the nozzle at a rate of 7.1 kg/min by the compressed air which was supplied at a sufficient pressure to form droplets but not so high as to cause the droplets to penetrate right through the falling curtain of ammonium nitrate prills.

The falling stream of ammonium nitrate prills mixed with the liquid precursor droplets was allowed to drop out of the casing into the simulated borehole to form a mass within the borehole. After a short time interval the reaction between the polyurethane ingredients caused the formation of a foam which swelled up within the borehole to the desired height, of about 6 meters, carrying with it ammonium nitrate prills which were subsequently completely immobilised by the solidification of the foam matrix. The result was that a continuous column of a foamed AN/PF explosive composition was formed in the bottom 6 meters of the simulated borehole; the average density of the column being 0.37 t/m$^3$.

EXAMPLES 2 TO 7

The procedure according to example 1 was repeated except that the feed rates of the ammonium nitrate prills and the liquid polyurethane precursor were varied thus producing explosive compositions containing various proportions of foam. Columns having an even distribution of density were produced having average densities as recorded in Table 1.

TABLE 1

| Examples | AN (Kg/min) | Polyurethane Precursor (Kg/min) | % PF by weight | Loading Rate (Kg/min) | Average Density t/m$^3$) |
|---|---|---|---|---|---|
| 1 | 23.0 | 7.1 | 23.6 | 30.1 | 0.37 |
| 2 | 25.2 | 5.9 | 18.8 | 31.1 | 0.53 |
| 3 | 10.6 | 4.2 | 28.4 | 14.8 | 0.30 |
| 4 | 12.6 | 3.5 | 21.7 | 16.1 | 0.41 |
| 5 | 15.9 | 4.0 | 20.1 | 19.9 | 0.54 |
| 6 | 14.7 | 5.0 | 25.4 | 19.7 | 0.36 |

TABLE 1-continued

| Examples | AN (Kg/min) | Polyurethane Precursor (Kg/min) | % PF by weight | Loading Rate (Kg/min) | Average Density t/m³) |
|---|---|---|---|---|---|
| 7 | 15.5 | 4.6 | 22.7 | 20.1 | 0.39 |

The even-ness of composition within the column was shown by removing the column produced in example 7 and dividing it into 1 meter lengths.

The density of each length was measured. The results recorded in Table 2 show that there is very little variation between lengths.

TABLE 2

| Section | Average density 1 m sections from base. 1 | 2 | 3 | 4 | 5 | 6 |
|---|---|---|---|---|---|---|
| Density (t/m³) | 0.40 | 0.36 | 0.39 | 0.38 | 0.37 | 0.41 |

It was observed that in spite of the intermittent operation of the loading apparatus as the boreholes were being loaded in these examples, no significant buildup occurred and there was no need to clean out the apparatus between runs.

EXAMPLES 8–12

Columns of foamed AN/PF explosive compositions were made by the procedure detailed in example 1. The columns were removed from the simulated boreholes, which were of various diameters, and 2 meter lengths of the columns were detonated in accordance with the conditions listed in Table 3.

TABLE 3

| Example No | AN/PF Composition % by weight AN | PF | Density (t/m³) | Diameter (mm) | Booster (g) | VOD (m/sec) |
|---|---|---|---|---|---|---|
| 8 | 84.5 | 15.5 | 0.6 | 150 | 400 | 2 700 |
| 9 | 77 | 23 | 0.4 | 200 | 250 | 2 200 |
| 10 | 77 | 23 | 0.4 | 300 | 400 | 3 000 |
| 11 | 77 | 23 | 0.4 | 300 | 250 | 2 900 |
| 12 | 71.5 | 28.5 | 0.3 | 300 | 400 | 2 000 |

EXAMPLES 13 TO 15

Cartridges of foamed AN/PF explosive compositions suitable for loading into boreholes in a mine or quarry were made using the procedure detailed in example 1 except that the simulated borehole was replaced by cardboard or steel tubes of the dimensions listed in Table 4.

TABLE 4

| Example No | Material of tubing | Diameter of tubing mm | Length of tubing mm |
|---|---|---|---|
| 13 | Cardboard | 125 | 750 |
| 14 | Cardboard | 80 | 600 |
| 15 | Steel | 100 | 1 150 |

The cartridge made in example 15, which contained an AN/PF composition of density of 0.55 t/m³, was initiated by a 50 g explosive booster. The VOD of the explosion was 2800 m/sec.

EXAMPLES 16–20

Figure 3:
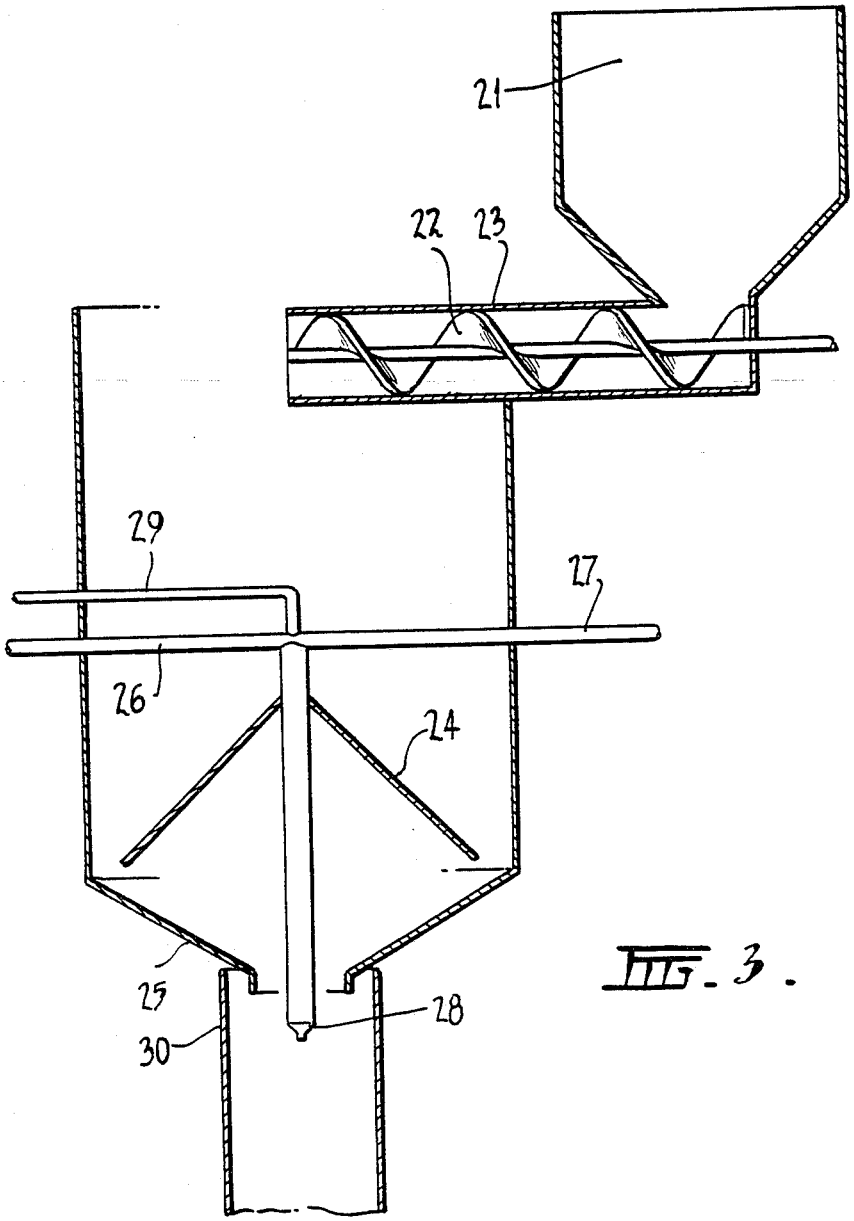
FIG. 3 is a diagrammatic representation of the apparatus.

An apparatus such as illustrated by FIG. 3, which is a diagrammatic representation not to scale, was used to make and place various AN/PF compositions into cylindrical containers.

The AN/PF loading apparatus comprised a hopper 21 from which the contents could be extracted at a controlled rate by controlling the speed of an auger 22 which was mounted horizontally within a cylindrical casing 23 of 29 mm internal diameter.

A deflecting cone 24 of 58 mm basal diameter was mounted centrally below the auger exit and axially above a collecting funnel 25 of 70 mm opening diameter.

Liquid polyurethane precursor was formed from two ingredients "Suprasec" DND and "Daltolac" 41 which were separately pumped through inlets 26 and 27 in metered quantities such that the weight ratio of "Suprasec" to "Daltolac" was 1.8:1 to the spray nozzle 28 to which there was also a supply of air 29. The combined delivery rate of the foam ingredients was maintained at 0.329 kg/min.

Ammonium nitrate prills were withdrawn from the hopper 21 by the auger 22 at preset constant rates in the range 1.1–3 kg/min to produce explosive compositions of different densities. The prills fell from the auger exit over the deflecting cone 24 and into the concentrating funnel 25 to form a uniform hollow stream around the spray nozle 28. Around this nozzle and below the concentrating funnel was placed a 50 mm diameter tubular product guide 30 to facilitate the fitting of the cylindrical containers not shown in the figure located below the apparatus.

Cylindrical containers of diameters given in Table 5 fitted with the various explosive compositions, in this manner were detonated underwater.

The bubble energy yields are recorded in Table 5.

TABLE 5

| Example No | Density g/cm³ | Cylinder Diameter mm | Pentolite Booster wt. g. | Underwater Bubble Energy MJ/kg |
|---|---|---|---|---|
| 16 | 0.27 | 225 | 250 | 1.67 |
| 17 | 0.34 | 180 | " | 1.92 |
| 18 | 0.47 | 180 | " | 1.91 |
| 19 | 0.51 | 225 | " | 1.98 |
| 20 | 0.60 | 180 | " | 2.10 |

We claim:

1. A process for the preparation of an explosive composition comprising a dispersion of an explosive component located in and immobilized by a solidified foamed non-explosive matrix which process comprises: forming a hollow stream of solid particles of said explosive component; mixing said stream of solid particles with a stream of liquid droplets comprising a precursor for said foamed non-explosive matrix by generating a stream of said liquid droplets within said hollow stream of solid particles; and introducing said stream of solid particles and liquid droplets into a container.

2. A process according to claim 1 wherein said stream of solid particles comprises a hollow cylindrical falling stream of solid particles which is generated by causing a falling stream of solid particles to impinge on a cone shaped deflector.

3. A process according to claim 2 wherein said stream of liquid droplets comprises a falling stream of liquid droplets which is generated by spraying said liquid within said hollow cylindrical falling stream of solid particles.

4. A process according to claim 1 wherein said explosive component comprises a particulate inorganic oxygen releasing salt.

5. A process according to claim 4 wherein said particulate inorganic oxygen releasing salt comprises ammonium nitrate.

6. A process according to claim 5 wherein the ammonium nitrate comprises particles in the size range of from 1000 microns to 3000 microns.

7. A process according to claim 1 wherein said solidified foamed non-explosive matrix comprises a polyurethane foam.

8. A process according to claim 1 wherein said container is a borehole.

* * * * *